US007254348B2

(12) United States Patent
Yahagi

(10) Patent No.: US 7,254,348 B2
(45) Date of Patent: Aug. 7, 2007

(54) IMAGE FORMING APPARATUS WITH REPLENISHMENT DEVELOPER DEVICE

(75) Inventor: Takashi Yahagi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 234 days.

(21) Appl. No.: 11/082,921

(22) Filed: Mar. 18, 2005

(65) Prior Publication Data

US 2005/0220463 A1 Oct. 6, 2005

(30) Foreign Application Priority Data

Mar. 31, 2004 (JP) ..... 2004-105758

(51) Int. Cl.
*G03G 15/08* (2006.01)

(52) U.S. Cl. ..... 399/27

(58) Field of Classification Search ..... 399/27–30, 399/61–65

See application file for complete search history.

(56) References Cited

U.S. PATENT DOCUMENTS

| | | | | |
|---|---|---|---|---|
| 5,754,916 A * | 5/1998 | Kitayama et al. | ..... | 399/27 |
| 5,848,326 A * | 12/1998 | Komuro et al. | ..... | 399/98 |
| 6,240,264 B1 * | 5/2001 | Yajima et al. | ..... | 399/82 |

FOREIGN PATENT DOCUMENTS

| | | | |
|---|---|---|---|
| JP | 62293267 A | * | 12/1987 |
| JP | 2-21519 | | 5/1990 |
| JP | 2000056639 A | * | 2/2000 |
| JP | 2003-215903 | | 7/2003 |

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

Provided is an image forming apparatus equipped with a developing apparatus using a developer containing toner and carrier, in which, by taking into account a change in the toner density of a replenishment agent, the supply of replenishment agent to the developing apparatus is effected with high accuracy, thereby forming a stable image involving no scattering of toner. In the image forming apparatus including a replenishment agent supply device that supplies a replenishment agent containing the toner and the carrier to the developing apparatus, the replenishment agent is gradually supplied to the developing apparatus from the replenishment agent supply device while the developer is gradually discharged in correspondence therewith from a developer discharging port, and the replenishment agent supply device has a first toner density detecting device for detecting the toner density of the replenishment agent.

6 Claims, 8 Drawing Sheets

IMAGE FORMING APPARATUS WITH REPLENISHMENT DEVELOPER DEVICE

BACKGROUND OF THE INVENTION

1. Field of the Invention

The present invention relates to an image forming apparatus equipped with a developing apparatus for use in an electrophotographic copying machine, a printer, a facsimile apparatus, etc., and in particular, to an image forming apparatus equipped with a developing apparatus using a developer containing toner and carrier.

2. Related Background Art

Conventionally, in an image forming apparatus, such as an electrophotographic copying machine, a developing apparatus effecting development by a two-component developing system using a two-component developer containing a mixture of toner and carrier, is generally widely used. In particular, in the case of color image forming apparatuses, from the viewpoint of image color tint, etc., many developing apparatuses use a two-component developer.

In a developing apparatus using a two-component developer, the toner is consumed by developing operation, and new toner is supplied in an amount corresponding to the consumed amount. In contrast, the carrier is not consumed but remains in a developing container, which is a developer accommodating portion of the developing apparatus. Thus, the carrier, which is agitated together with the toner, is degenerated by being agitated. The degeneration of the carrier occurs as a result of adhesion of toner to the surface of the carrier due to the friction when agitating the developer and to the compression during passage through the gap between a developing roller serving as a developer carrier for carrying developer to the developing position by rotating and a developer regulating member (developer regulating blade) for regulating the thickness of the toner layer on the developing roller. Degeneration of the carrier results in a deterioration in the charging performance of the developer. In view of this, it is general practice to periodically replace the carrier.

To replace the carrier, the developer is discharged through a developer discharging port provided in the developing apparatus, and the developing apparatus is filled with new developer. That is, the replacement of the carrier substantially means the total replacement of the developer in the developing apparatus, and in this process, the toner is naturally also renewed. During the replacement operation, it may occur that the toner, which is in the powder form, is scattered to stain the image forming apparatus and the periphery thereof.

In view of this, there has been proposed a developing apparatus in which the degeneration of the developer is restrained, so there is no need to perform the developer replacement operation (see, for example, Japanese Patent Publication No. H02-21519. The apparatus adopts a system generally referred to as a trickle system, in which a discharge port is provided at a predetermined height on a side wall of a housing constituting the developing container of the developing apparatus, and in which a developer containing toner and carrier is supplied to the developing apparatus, whereby surplus developer in the developing apparatus is successively discharged through the discharge port, thereby keeping the characteristics of the developer fixed (see, for example, Japanese Patent Application Laid-Open No. 2003-215903).

The above-mentioned conventional apparatus, however, has a problem in that, when the toner density of the developer to be replenished (replenishment agent) and the T/D ratio, which is the ratio of toner to developer, fluctuate, the toner replenishment accuracy deteriorates, with the result that the toner supply to the developing apparatus becomes deficient or excessive.

When the toner supply becomes deficient or excessive, the toner density of the developer in the developing apparatus fluctuates, which may lead to a fluctuation in the toner image density or scattering of toner from the developing apparatus.

Alternatively, due to a fluctuation in environmental conditions such as humidity, the electric charge of the toner (triboelectricity) fluctuates, which leads to a change in bulk density and a deterioration in the accuracy with which developer is supplied to the developing apparatus, with the result that the toner supply to the developing apparatus becomes deficient or excessive, thus involving the same problem as mentioned above.

SUMMARY OF THE INVENTION

It is an object of the present invention to provide an image forming apparatus equipped with a developing apparatus using a developer containing toner and carrier, in which, taking into account a change in the toner density of a replenishment agent, the supply of replenishment agent to the developing apparatus is effected with high accuracy, thereby forming a stable image involving no scattering of toner.

The above object is attained by the image forming apparatus according to the present invention. That is, the present invention provides an image forming apparatus including: an image bearing member having a surface on which an electrostatic latent image is formed; a developing apparatus that develops the electrostatic latent image with a developer containing toner and carrier; and a replenishment agent supply device that supplies a replenishment agent containing the toner and the carrier to the developing apparatus, in which the replenishment agent is gradually supplied to the developing apparatus from the replenishment agent supply device while the developer is gradually discharged in correspondence therewith through a developer discharging port, and in which the replenishment agent supply device comprises a first toner density detecting means for detecting the toner density of the replenishment agent.

According to an aspect of the present invention, the first toner density detecting means is arranged in the vicinity of a portion where the replenishment agent is supplied to the developing apparatus.

According to another aspect of the present invention, the supply of the replenishment agent to the developing apparatus is effected based on a replenishment amount set by a replenishment table, and in which the replenishment table is switched based on the density detected by the first toner density detecting means.

According to another aspect of the present invention, the first toner density detecting means is an inductance detection sensor that detects a magnetic permeability of the replenishment agent, and a developer replenishment table taking into account a change in the bulk density of the replenishment agent is obtained from the detection value of the first toner density detecting means, and in which the supply of the replenishment agent to the developing apparatus is effected according to the replenishment table obtained.

According to another aspect of the present invention, the replenishment agent supply device carries and supplies the replenishment agent by rotating a spiral member, and includes an agitating means arranged in the vicinity of the first toner density detecting means and adapted to agitate the replenishment agent.

According to another aspect of the present invention, the replenishment agent supply device has a detachable replenishment agent container for containing the replenishment agent, the replenishment agent container being selected from at least two or more kinds of replenishment agent container differing in the toner density of the replenishment agent contained therein.

According to another aspect of the present invention, the image forming apparatus includes a second toner density detecting means for detecting the toner density of the developer contained in the developing apparatus, the replenishment table being set in terms of the amount of replenishment agent supplied to the developing apparatus from the replenishment agent supply device in correspondence with the detection result of the second toner density detecting means.

The image forming apparatus of the present invention has a replenishment agent supply device for supplying replenishment agent containing toner and carrier to the developing apparatus, in which the replenishment agent is gradually supplied to the developing apparatus from the replenishment agent supply device while the developer is gradually discharged in correspondence therewith through a developer discharge port, and in which the replenishment agent supply device has a first toner density detecting means for detecting the toner density of the replenishment agent, so that, by detecting the toner density of the replenishment agent, it is possible to supply toner with high accuracy even if the toner density of the developer to be supplied to the developing apparatus fluctuates, thus making it possible to provide an image forming apparatus capable of forming a stable image involving no scattering of toner.

Further, it is possible to provide an image forming apparatus which is capable of effecting toner supply with high accuracy even if an environmental condition, such as humidity, fluctuates and which is capable of forming a stable image involving no scattering of toner.

DESCRIPTION OF THE PREFERRED EMBODIMENTS

In the following, an image forming apparatus according to the present invention will be described in more detail with reference to the drawings.

Embodiment 1

Figure 8:
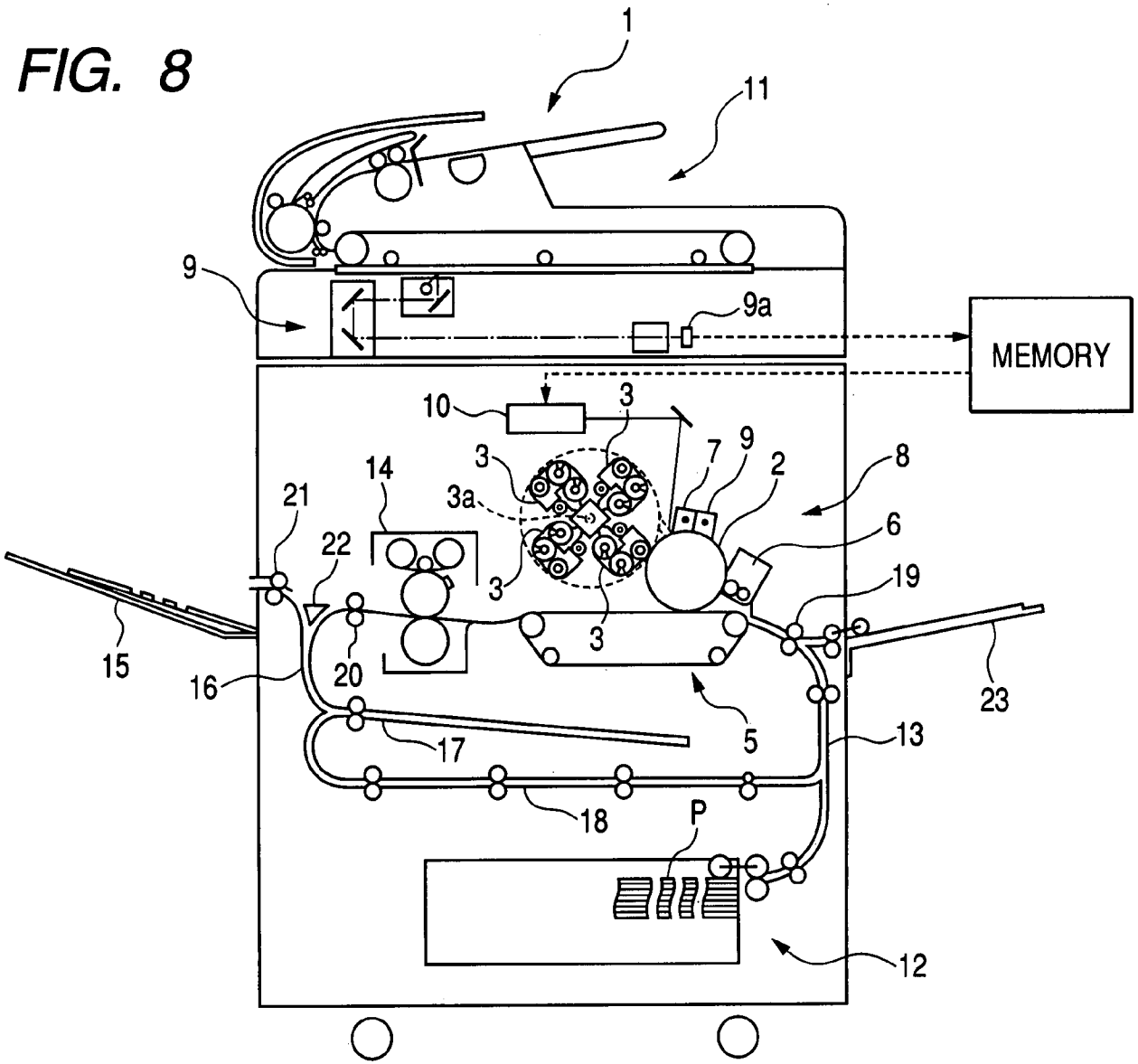
FIG. 8 is a diagram schematically showing the construction of an example of an image forming apparatus according to the present invention.

An image forming apparatus 1 according to an embodiment of the present invention will be described with reference to FIG. 8. FIG. 8 is an explanatory sectional view schematically showing the schematic construction of a color electrophotographic copying machine constituting the image forming apparatus.

The copying machine 1 shown in FIG. 8 has, for example, a drum-shaped electrophotographic photosensitive member (photosensitive drum) 2 serving as an image bearing member. Through rotation of the photosensitive drum 2, a development image (toner image) based on a desired image is formed on a peripheral surface of the photosensitive drum 2 by image forming means around it.

As the image forming means, a primary charger 7 uniformly charges the surface of the photosensitive drum 2, and an exposure portion 10 exposes image information on the uniformly charged surface of the photosensitive drum 2 to form a latent image. An original with a desired image recorded thereon is guided by an original treatment apparatus 11 to an optical reading system 9 constituting an image reading portion, and the above-mentioned image information is read from the original by a CCD 9*a* constituting the optical reading system 9.

The latent image formed on the peripheral surface of the photosensitive drum 2 by the exposure portion 10 is visualized by a developing apparatus 3 constituting the image forming means by causing toner contained in a developer to adhere thereto. That is, it is developed into a toner image.

The toner image thus visualized on the photosensitive drum 2 is transferred to a sheet P serving as the recording medium by a transfer means 5 constituting the image forming means.

After the transfer of the surface toner image, the residual developer and other adhering materials are removed from the surface of the photosensitive drum 2 by a cleaning device 6 for next image formation.

In this example, four developing apparatuses 3 are mounted on a rotary 3*a*, and through rotation thereof, they are successively conveyed to a position where they are opposed to the photosensitive drum 2. The developing apparatuses 3 each contain developers of different colors, e.g., developers respectively having pigments of yellow, magenta, cyan, and black. First, a toner image of a first color is formed on the photosensitive drum 2, and is transferred to the sheet P. After the residual developer after the transfer (toner) of the toner image of the first color on the photosensitive drum 2 has been removed by the cleaning device 6, the photosensitive drum 2 is charged again, and a toner image of a second color is formed to be transferred to the sheet P so as to be superimposed on the toner image of the first color transferred thereto. In this way, toner images of the four colors are successively transferred to the sheet P so as to be superimposed one upon the other, and a full color toner image is formed on the sheet P.

Here, the photosensitive drum 2, the developing apparatuses 3, the transfer means 5, the cleaning device 6, and the primary charger 7 constitute an image forming portion 8.

When it consists of an ordinary paper sheet, the sheet P constituting the recording medium is fed from a sheet feeding portion 12, and conveyed through a main body path 13. When it consists of a special kind of sheet, such as an OHP or a thick sheet, the sheet P is fed from a manual feed tray 23, and conveyed to the image forming portion 8. Then, the sheet P is sent by registration rollers 19 arranged in the vicinity of the photosensitive drum 2 to a position where the toner images formed on the photosensitive drum 2 are transferred thereto by the transfer means 5.

The toner images transferred to the sheet P in the image forming portion 8 are fixed to the sheet P by a fixing apparatus 14, whereby a desired image product is completed. Thereafter, the sheet P is conveyed by inner discharging rollers 20 and reaches a discharging portion flapper 22, where the conveying path for the sheet P is switched according to whether it is discharged as it is or printing is also effected on the rear surface of the sheet. In the case in which it is discharged as it is, the sheet P is conveyed to a sheet discharging portion 15 provided on the side surface of the image forming apparatus 1 in this case by outer discharging rollers 21 before being discharged to the exterior of the image forming apparatus 1. When printing is to be performed also on the rear surface of the sheet, the sheet P is conveyed to a re-feed path 16 for guiding the sheet to be re-fed at the time of two-side recording, and is reversed by a sheet surface reverse path 17. The reversed sheet P is conveyed to the registration rollers 19 by way of a duplex transport path 18 before being sent to the image forming portion 8 again.

The above-described construction of the image forming apparatus is only given by way of example, and it is also possible to adopt some other type of construction. For example, it is also possible to adopt an electrostatic recording type image forming apparatus, or an intermediate transfer system in which after transferring toner images of four colors to an intermediate transfer member by using the intermediate transfer member as a transfer means, the toner images are collectively transferred to the sheet P. Further, the construction of the image forming means may be other than that shown in FIG. 8. If the electrophotographic system is adopted, it is possible to use, instead of the photosensitive drum 2, a photosensitive belt which is a belt-shaped electrophotographic photosensitive member. Further, the present invention is not restricted to a so-called 1D-type image forming apparatus as shown in FIG. 8, in which one photosensitive drum and four developing apparatuses are used. The present invention is also applicable to a monochrome image forming apparatus, or an in-line type image forming apparatus in which a plurality of photosensitive drums and image forming means acting thereon are arranged as the image forming portions. Of course, there are no particular limitations regarding the number of developing apparatuses 3 and the number of colors of developers to be used.

Here, in the image forming apparatus of this embodiment, the developing apparatuses 3 execute a two-component type development, and the developing apparatuses 3 accommodate developers containing toners and carriers. Here, a developing apparatus 3 and a replenishment agent supply device 4 for supplying replenishment agent thereto will be described with reference to FIGS. 1, 2, and 3.

The developing apparatus 3 is of a contact magnetic brush development type using a two-component developer containing toner and carrier.

To effect replacement of developer, that is, automatic refreshment of the carrier (ACR), the developing apparatus 3 is supplied with replenishment agent containing toner and carrier, and at the same time, discharge of developer is conducted. In the developing apparatus 3 of this embodiment, the toner density in the developing apparatus 3, that is, the mass mixture ratio of toner T to developer D, i.e., the T/D ratio, is 8%, and the T/D ratio of the replenishment agent is 85%.

Figure 1:
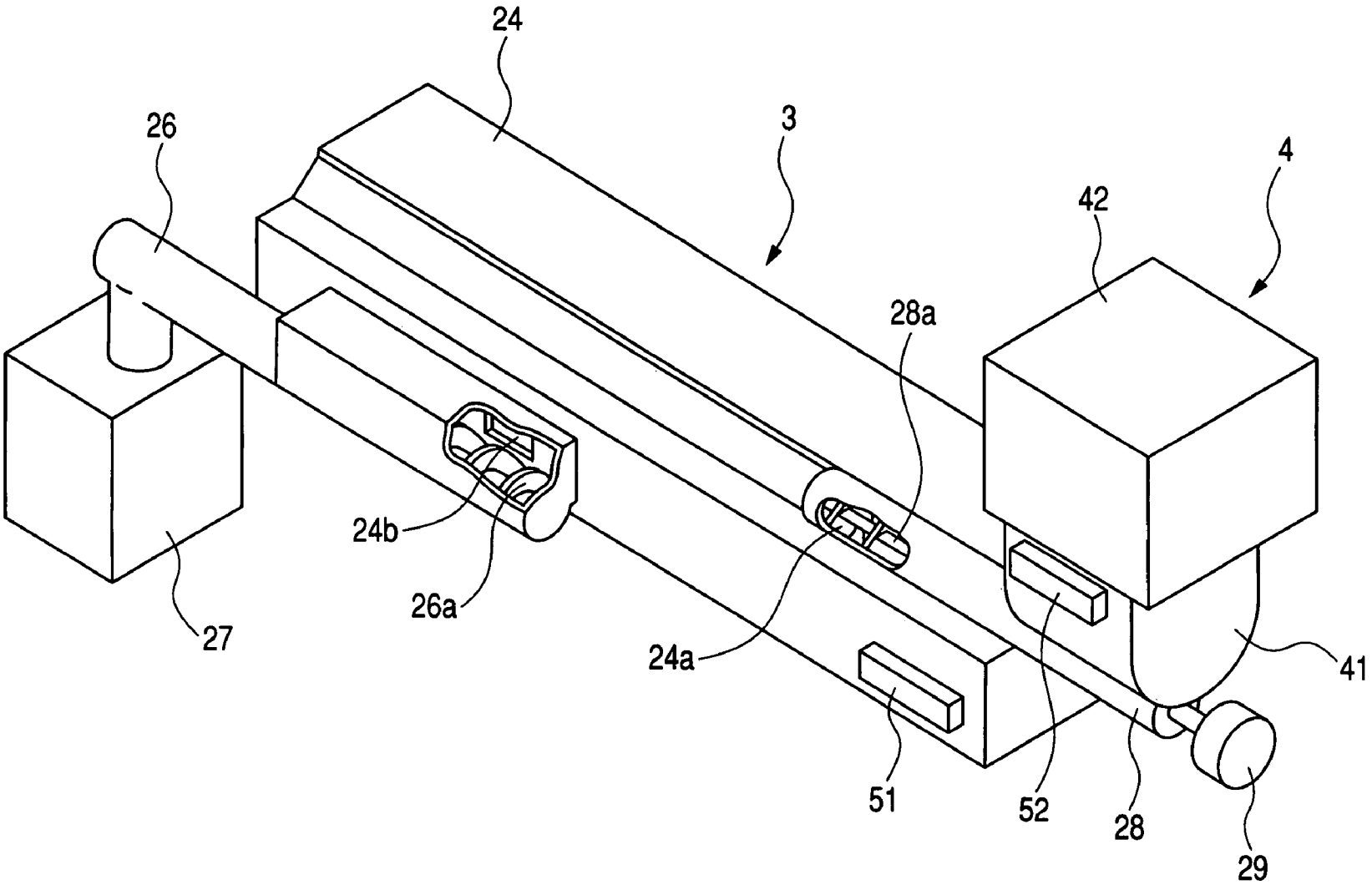
FIG. 1 is a perspective view of an example of a developing apparatus and a replenishment agent supply device according to the present invention.

As shown in FIG. 1, the developing apparatus 3 is equipped with a developing container 24 that performs development while circulating two-component developer, a replenishment agent supply means that executes supply of developer from a toner bottle 42 which is a replenishment agent container accommodating new toner and carrier, and a developer discharging means that recovers degenerated developer in a developer recovery tank 27.

The developing apparatus 3 is equipped with the developing container 24 that performs development while circulating two-component developer, and a discharging pipe 26 for discharging degenerated developer. Inside the discharging pipe 26, there is arranged a screw 26*a*, which discharges degenerated developer into the developer recovery tank 27. At the lower end of the discharging pipe 26, there is detachably mounted the developer recovery tank 27. The replenishment agent supply device 4 for supplying replenishment agent is connected to the developing apparatus 3.

The developing container 24 has a replenishment agent supply port 24*a* and a developer discharging port 24*b*. The discharging pipe 26 is connected to the developer discharging port 24*b*.

Figure 2:
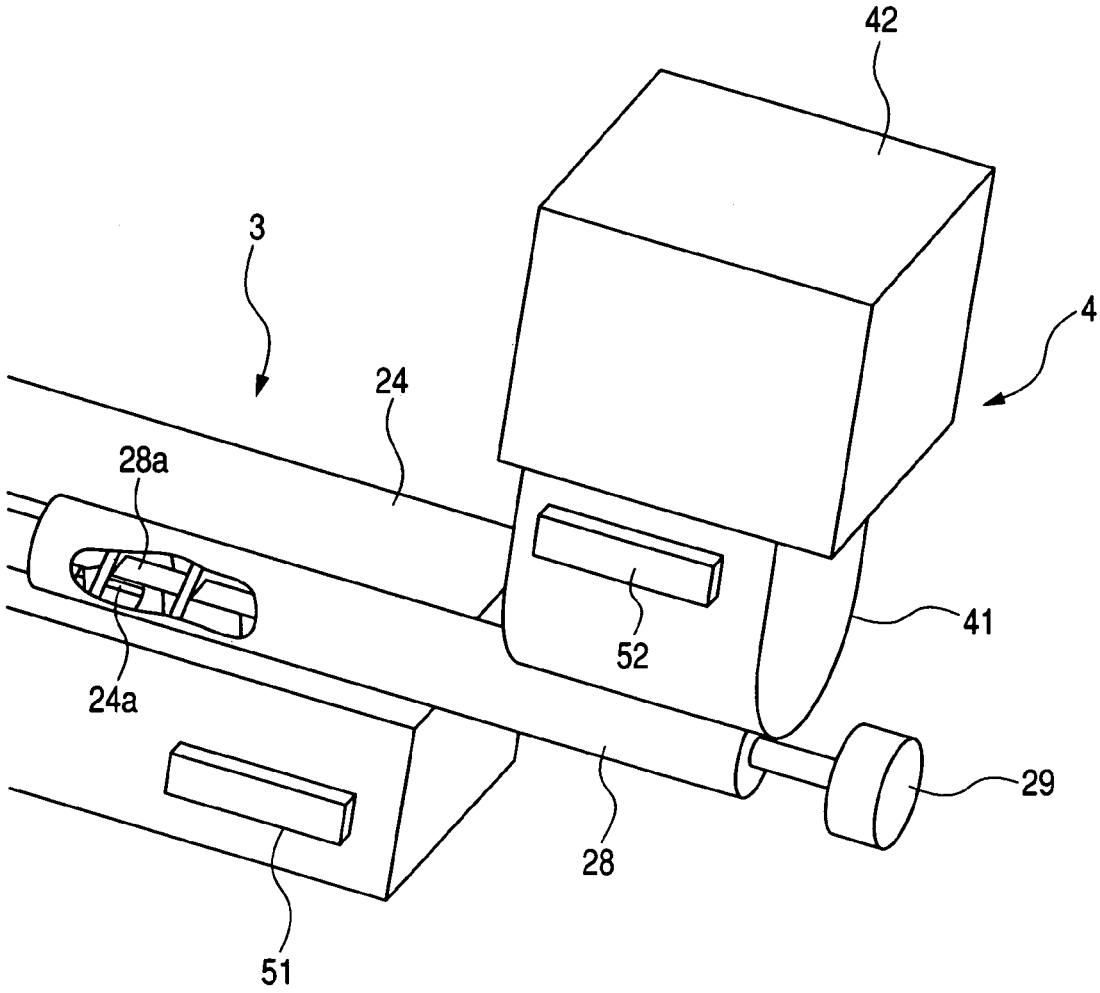
FIG. 2 is a perspective view of an example of the replenishment agent supply device according to the present invention.

At the replenishment agent supply port 24*a*, there is formed, as the replenishment agent supply means, a replenishment agent carrying path 28 for carrying and supplying toner and carrier stored in the toner bottle 42 of the replenishment agent supply device 4 shown in detail in FIG. 2. A replenishment screw 28*a*, which is a spiral member, is arranged in the replenishment agent carrying path 28. The replenishment screw 28*a* is rotated by a developing device driving motor (not shown) through a clutch. Integrally mounted at the upstream end of the developer carrying direction of the replenishment screw 28*a* is an encoder 29 for detecting the rotating amount of the replenishment screw 28*a*. In this way, the toner and carrier stored in the toner bottle 42 is to be supplied through the replenishment screw 28*a*.

Figure 3:
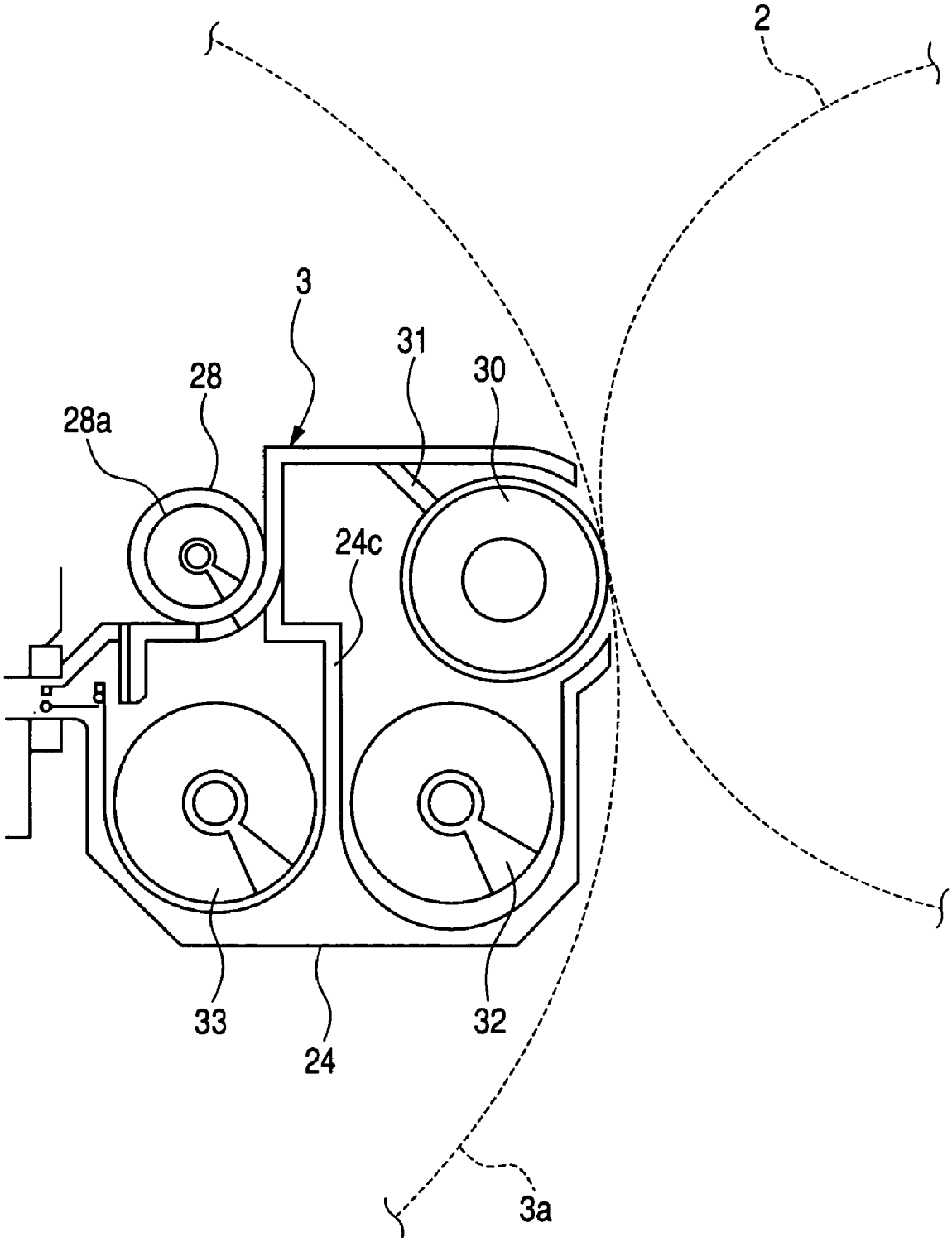
FIG. 3 is a sectional view of an example of the developing apparatus according to the present invention.

As shown in FIG. 3, in the developing container 24, there are arranged, so as to be opposed to the photosensitive drum 2, a developing roller 30 serving as a developer carrier for carrying developer contained in the developing container 24 to the surface of the photosensitive drum 2, a layer thickness regulating member 31 spaced apart from the developing roller 30 by a predetermined distance and formed of a non-magnetic material for regulating the layer thickness of the developer carried on the developing roller 30, a screw 32 adapted to agitate and supply developer onto the developing roller 30, and a screw 33 for carrying developer.

Further, as shown in FIG. 3, the interior of the developing container 24 is divided by a partition wall 24*c* into upstream and downstream sides with respect to the developer carrying direction. The screws 32 and 33 are respectively arranged in upstream side and downstream side accommodating portions defined by the partition wall 24*c*. The end portions of the partition wall 24*c* do not reach the inner side surface of the developing container 24, and the upstream and downstream sides with respect to the developer carrying direction communicate with each other at these end portions.

Figure 4:
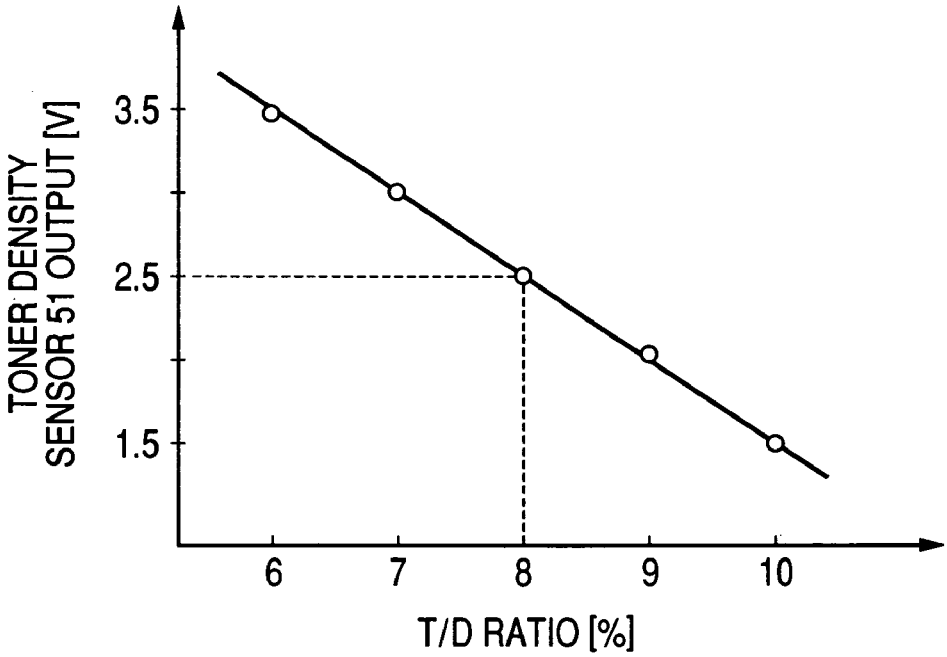
FIG. 4 is a graph showing the relationship between an output value of a second toner density detecting means according to the present invention and the T/D ratio in the developing apparatus.

As shown in FIGS. 1 and 2, arranged on the developing container 24 is a toner density detecting means (toner density sensor) 51 for detecting the T/D ratio of the developer contained in the developing container 24. The toner density sensor 51 is an inductance detection sensor which detects density by detecting the magnetic permeability of the developer. FIG. 4 shows the relationship between the T/D ratio and the output of the toner density sensor 51 when the room temperature is 23° C. and the humidity is 50% rh. As shown in the drawing, when, for example, the magnetic permeability is reduced, it means that the T/D ratio of the developer has increased; conversely, when the magnetic permeability is increased, it means that the T/D ratio of the developer has decreased. Thus, the output value of the sensor 51 is detected as the T/D ratio. Based on the detection value of the sensor 51, the toner consumption of the developer in the developing apparatus 3 is detected, and the rotating amount of the replenishment screw 28*a* is adjusted, supplying an appropriate amount of developer to the developing apparatus 3.

Due to this construction, when new replenishment agent is supplied from the replenishment agent supply device 4 to the developing apparatus 3 and the volume of the developer in the developing container 24 increases, the developer in the developing container 24 overflows from the developer discharging port 24*b*, thereby effecting automatic refreshment (ACR) of the carrier.

As shown in FIG. 1, in the developing container 24, the developer discharging port 24*b* is provided at one longitudinal end of the developing container 24. Further, in the developer carrying path in which developer is carried by the screws 32 and 33, the replenishment agent supply port 24*a* and the developer discharging port 24*b* are arranged in the following order: the position where the developer is replenished to the developing roller 30, the developer discharging port 24*b*, and the replenishment agent supply port 24*a*, in a direction from the upstream side to the downstream side, with the replenishment agent supply port 24*a* and the developer discharging port 24*b* being spaced apart from each other.

Here, as can be seen from FIG. 2, in this embodiment, the toner bottle 42 is provided in the replenishment agent supply device 4, and the replenishment agent supply device 4 is composed of a hopper portion 41 and the toner bottle 42, with the hopper portion 41 connecting the toner bottle 42 and the replenishment agent carrying path 28. The toner bottle 42 is replaceable with respect to the replenishment agent supply device 4. When the replenishment agent in the toner bottle 42 has been used up, the toner bottle 42 can be replaced by a new toner bottle. Inside the hopper portion 41, there is provided an agitating means (not shown), and a replenishment agent received from the toner bottle 42 is carried to the replenishment screw 28*a*.

Here, as stated above, the average T/D ratio of the replenishment agent accommodated in the toner bottle 42 is 85%, however, when filling the toner bottle 42 with toner and carrier or due to vibration, etc. during transportation, the distribution of the T/D ratio may cease to be uniform to become uneven. When the filling with toner was effected in the most uneven manner, the T/D ratio, which is 85% on the average, was 50 to 95% in some places.

The replenishment agent containing toner is supplied with a view to compensating for the toner consumption as a result of image formation. However, when the T/D ratio of the replenishment agent is changed with respect to the desired toner supply amount, the amount of toner to be supplied fluctuates, making it impossible to attain a desired value of T/D ratio in the developing apparatus.

In this way, when the toner density of the developer (replenishment agent) to be supplied and the T/D ratio, which is the ratio of toner to developer, fluctuates, the accuracy with which toner is supplied deteriorates in the conventional apparatus as described above, resulting in fluctuation in the toner density of the developer in the developing apparatus, a variation in image density, scattering of toner, or the like.

In view of this, as a feature of this embodiment, a toner density sensor 52 is provided on the hopper portion 41 equipped with the agitating means of the replenishment agent supply device 4, and the T/D ratio of the replenishment agent is detected, the supply of replenishment agent being effected with the replenishment table for the replenishment agent changed.

Figure 5:
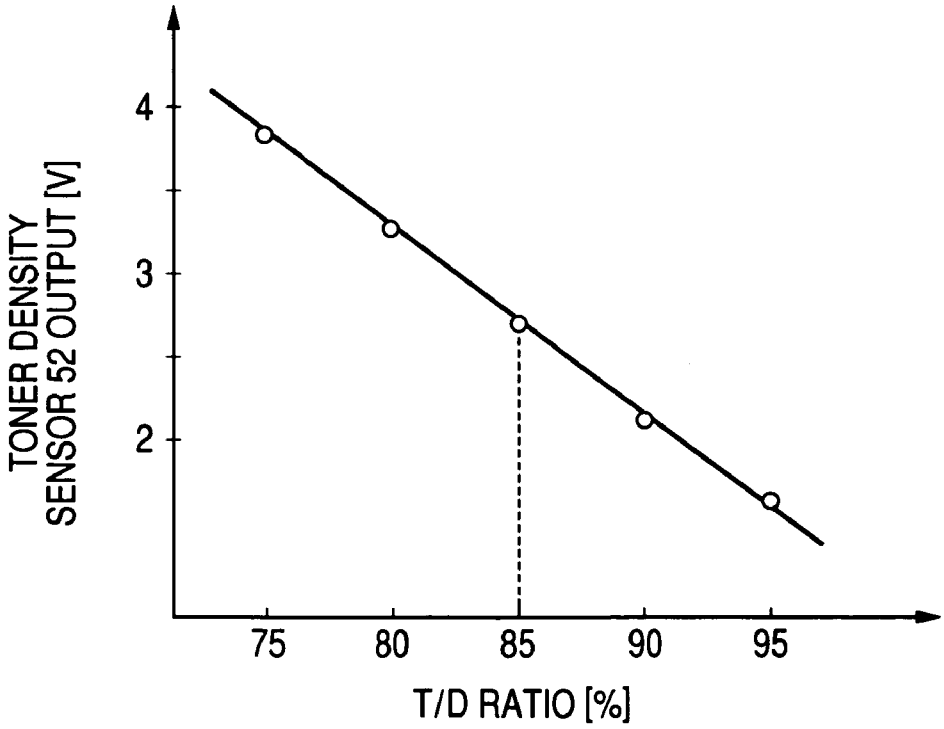
FIG. 5 is a graph showing the relationship between an output value of a first toner density detecting means according to the present invention and the T/D ratio of the replenishment agent.

Like the toner density sensor 51 of the developing container 24, the toner density sensor 52 for detecting the T/D ratio of the replenishment agent provided on the hopper portion 41 is an inductance detection sensor that detects density by detecting the magnetic permeability of the replenishment agent. Since the T/D ratio of the replenishment agent is higher than that of the developer, the sensor is set so as to be suitable for high T/D ratio. FIG. 5 shows the relationship between the T/D ratio and the output of the toner density sensor 52 when the room temperature is 23° C. and the humidity is 50% rh. As in the case of the toner density sensor 51 of FIG. 4, when the magnetic permeability is reduced, it means that the T/D ratio of the developer has increased; conversely, when the magnetic permeability is increased, it means that the T/D ratio of the developer has decreased. Thus, the output value of the sensor 52 is detected as the T/D ratio.

In this embodiment, the replenishment table for the replenishment agent is changed according to the T/D ratio detection result. The replenishment table is a table showing the relationship between the output value of the toner density sensor 51 for detecting the toner density in the developing container 24, set in the control portion of the image forming apparatus main body controlling the operation of the image forming means, and the rotating amount of the replenishment screw 28*a* detected by the encoder 29. The rotating amount of the replenishment screw 28*a* means the supply amount of the developer.

Figure 6:
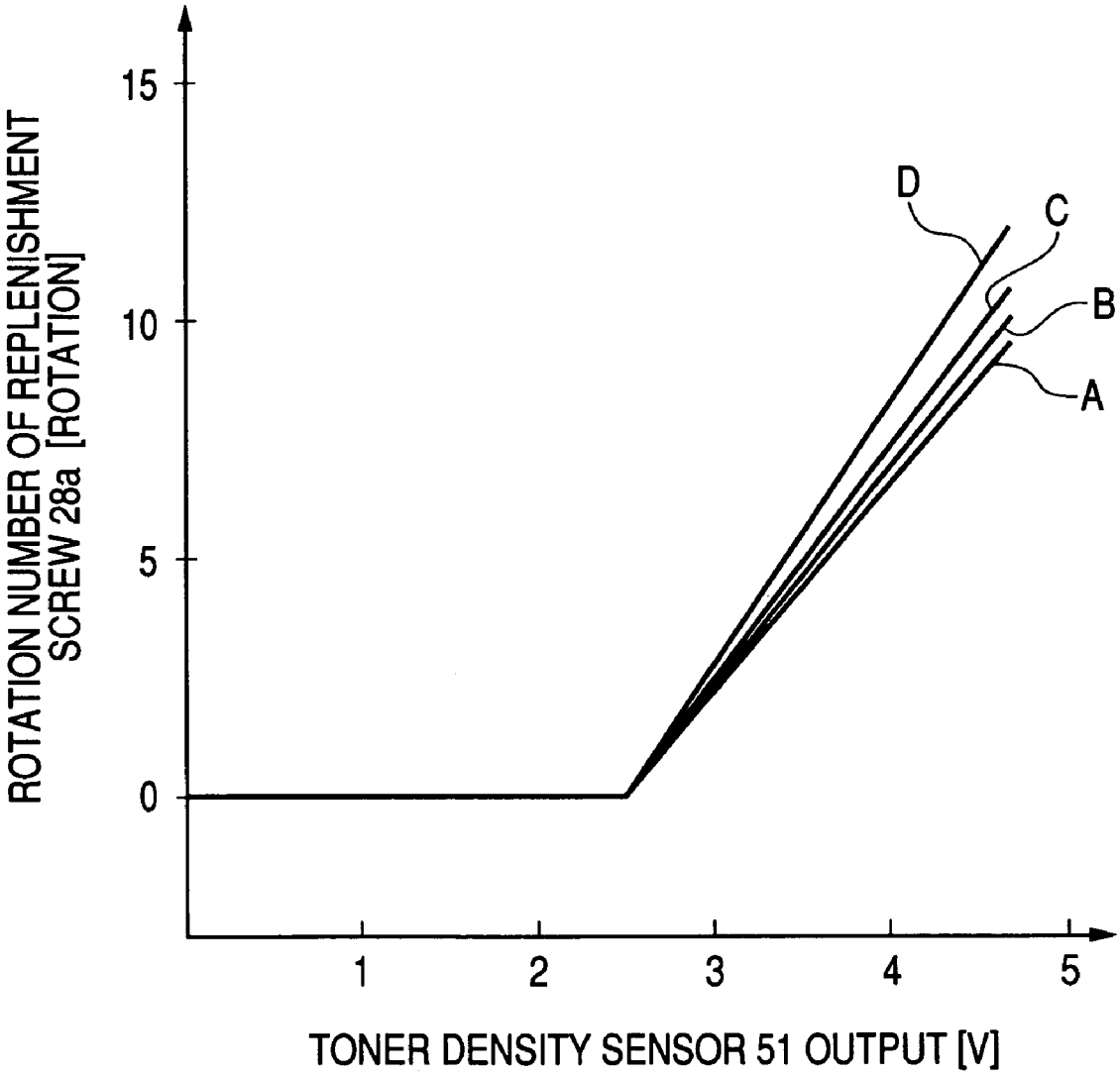
FIG. 6 is a diagram showing an example of a replenishment table according to the present invention.

FIG. 6 shows a replenishment table for use in toner replenishment control when the T/D ratio of the replenishment agent is different. The horizontal axis indicates the T/D ratio obtained from the output value of the toner density sensor 51, and the vertical axis indicates the rotating amount of the replenishment screw 28*a*.

Lines A, B, C, and D respectively correspond to the T/D ratios of the replenishment agent of 95%, 85%, 70%, and 55% as detected by the toner density sensor 52 installed on the replenishment agent supply device 4. The difference in the inclinations of the lines A to D is due to the difference in the amount of toner contained in the replenishment agent discharged through one rotation of the replenishment screw 28*a*.

The amount (mass) of toner contained in the replenishment agent discharged through one rotation of the replenishment screw 28*a* used in this embodiment was 0.202 g, 0.197 g, 0.188 g, and 0.174 g for the T/D ratio of the toner bottle 42 of 95%, 85%, 70%, and 55% in order, respectively. The less the amount of toner contained in the replenishment agent discharged through one rotation of the replenishment screw 28*a*, the steeper the inclination of the replenishment table.

The T/D ratio of the developing apparatus 3 of this embodiment accommodating 165 g of developer is 8%, so that the amount of toner in the developer is 13.2 g. The maximum toner consumption when successively forming images with the image forming apparatus of this embodiment (the toner consumption when an image of maximum density is placed on the entire original plate) is 13.8 g/min, and the toner thus consumed must be successively replenished.

That is, when there is no toner density sensor on the hopper portion 41 of the replenishment agent supply device 4, and replenishment is effected at the T/D ratio of 85% without detecting the accurate T/D ratio of the replenishment agent, the amount of toner contained in the replenishment agent discharged through one rotation of the replenishment screw 28*a* is 0.197 g, so that, in order to replenish 13.8 g of toner, the requisite number of times that the replenishment screw 28*a* is rotated is 70.

However, as stated above, there are cases in which the T/D ratio of the replenishment agent is reduced to approximately 55%. When the T/D ratio is 55%, the amount of toner contained in the replenishment agent is 12.18 g even if the replenishment screw 28*a* is rotated 70 times. That is, only 12.18 g of toner is replenished when 13.8 g of toner has been consumed, so that the amount of developer in the developing apparatus 3 is deficient by 1.62 g, and the T/D ratio of the developer in the developing apparatus 3 is reduced to 7% in one minute.

As in the case of this embodiment, when the T/D ratio of the replenishment agent is detected by the toner density sensor 52 of the hopper portion 41 of the replenishment agent supply device 4, and the rotating amount of the replenishment screw 28*a*, that is, the replenishment table, is selected according to the T/D ratio of the replenishment agent, it is possible to supply an accurate amount of toner to the developing apparatus 3.

Here, in this embodiment, it is possible to select a toner bottle 42 from a plurality of kinds of toner bottles containing replenishment agents of different toner densities and mount it to the replenishment agent supply device 4. Also in this case, the toner density of the replenishment agent is detected by the toner density sensor 52.

As stated above, when the distribution of the T/D ratio of the replenishment agent, which is 85% on the average, becomes uneven, there is a variation in T/D ratio within the range of 50 to 95%. For example, when, in order to expedite the replacement of the carrier of the developer of the developing apparatus 3, the toner bottle 42 is replaced by one in which the average T/D ratio is 20%, it may occur that the T/D ratio partially becomes approximately 10%.

In such cases, when detection of the T/D ratio of the replenishment agent is not effected by the toner density sensor 52, the T/D ratio of the developer in the developing apparatus 3 after one minute is reduced to 5.4%. In contrast, when the T/D ratio of the replenishment agent is detected by the toner density sensor 52 of the hopper portion 41, it is possible to supply an accurate amount of toner to the developing apparatus 3, making it possible to maintain the developer density at a fixed level.

Figure 7:
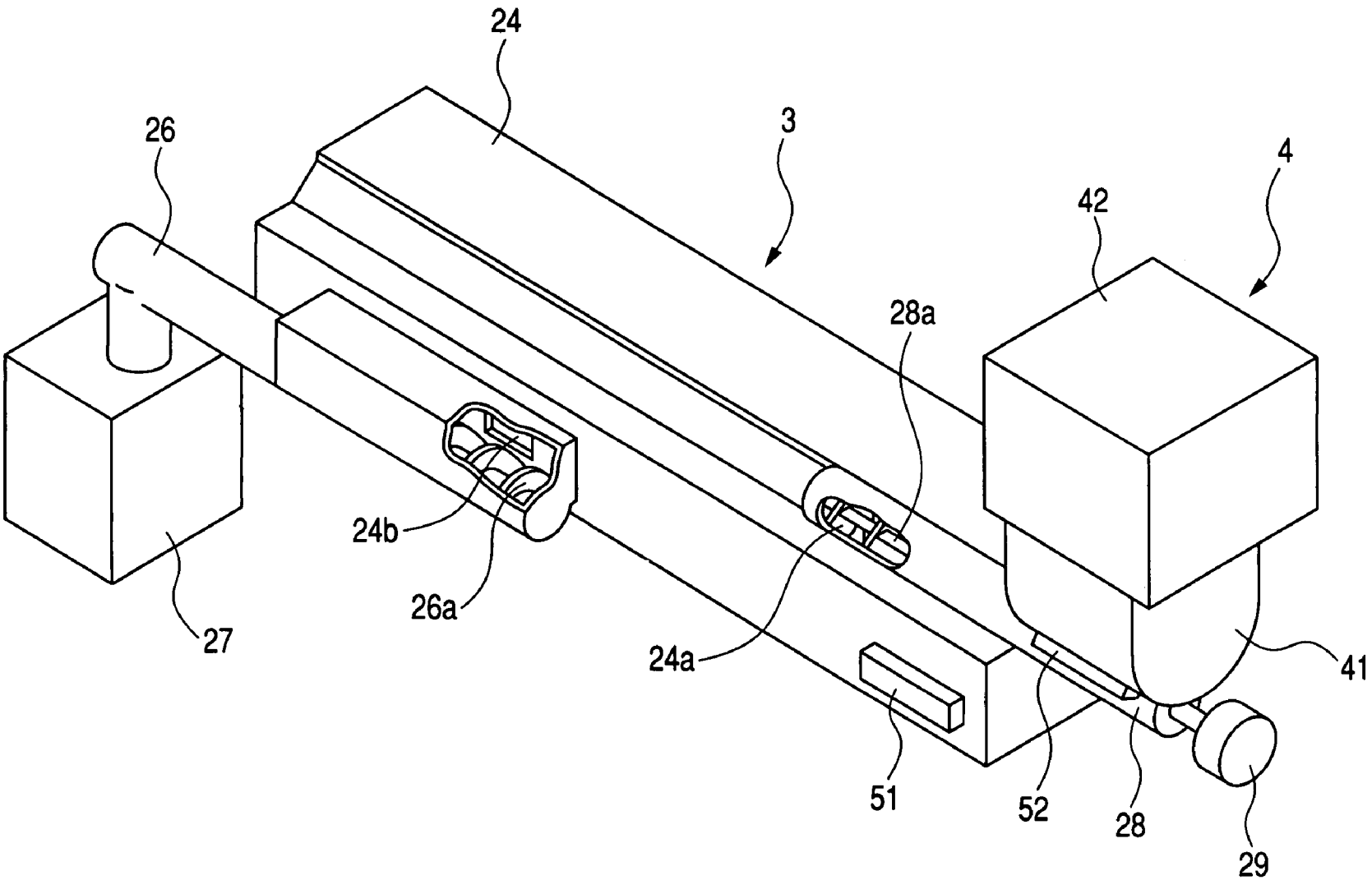
FIG. 7 is a perspective view of another example of a developing apparatus and a replenishment agent supply device according to the present invention.

It is desirable for the toner density sensor 52 to be provided in the vicinity of the agitating member (not shown) of the hopper portion 41 as in this embodiment. Further, since the toner density sensor 52 detects the T/D ratio of the replenishment agent supplied to the developing apparatus 3, it is desirable for the sensor to be on the side nearer to the developing apparatus 3. Thus, as shown in FIG. 7, it is possible to perform detection by arranging the toner density sensor 52 in the vicinity of the replenishment screw 28*a* serving as the agitating member, with the replenishment carrying path being a part of the replenishment agent supply device 4, and arranging it in the vicinity of the replenishment agent carried by the replenishment screw 28*a* and in the vicinity of the replenishment agent supply port 24*a*. In that case, it is more desirable to arrange the toner density sensor 52 on the side nearer to the developing apparatus 3 in a state in which the toner density sensor 52 is not affected by fluctuation in the output of the toner density sensor 52 due to the rotation period of the replenishment screw 28*a*.

Embodiment 2

The constructions of the image forming apparatus, the developing apparatus 3, and the replenishment agent supply device 4 of this embodiment are the same as those described with reference to Embodiment 1, so that a description thereof will be omitted. Also in this embodiment, the toner density sensor 52 for detecting the T/D ratio of the replenishment agent is arranged on the hopper portion 41 of the replenishment agent supply device 4 as shown in FIG. 1. The T/D ratio of the developer of this embodiment is 70%, and the sensitivity of the inductance detection sensor is adjusted to a level around the T/D ratio of 70%.

When the T/D ratio of the replenishment agent sufficiently agitated is fixed, the output value of the inductance detection sensor is generally determined. However, strictly speaking, it fluctuates depending on the bulk density of the replenishment agent.

That is, when containers containing the same developer are left to stand for 12 hours in different environments, their inductance detection sensor output values are different. For example, when the room temperature was 23° C. and the humidity was 50% rh, the inductance detection sensor output of a replenishment agent whose T/D ratio was 70% was 2.5 V, whereas, when this replenishment agent was left to stand in an environment in which the room temperature was 30° C. and the humidity was 90% rh for 2 hours, the inductance detection sensor output was 3.0 V.

This phenomenon is due to the fact that the inductance detection sensor performs detection on carrier, which is a magnetic substance. That is, due to the high humidity environment, the triboelectricity of the developer (the electric charge per unit mass) was reduced, and the bulk of the developer was reduced, that is, it was increased in density, with the result that the carrier amount per unit volume increased, thereby increasing the carrier amount in replenishment agent per unit volume. The increase in carrier amount is detected as an increase in carrier ratio, and an increase in carrier ratio means a reduction in toner ratio, that is, T/D ratio. Actually, however, only the bulk density of the replenishment agent is increased as a whole, and there is no change in T/D ratio, which is a mass ratio.

The supply of the replenishment agent is effected through rotation of the replenishment screw 28*a*. The accuracy with which the replenishment agent is supplied is influenced by the bulk density of the replenishment agent supplied by rotating the replenishment screw 28*a*.

That is, in the above environment in which the room temperature was 23° C. and the humidity was 50% rh, the amount of toner contained in the replenishment agent discharged through one rotation of the replenishment screw 28*a* was 0.188 g, whereas, in the case in which the room temperature was 30° C. and the humidity was 90% rh, the amount of toner contained was 0.193 g, and in the case in which the room temperature was 15° C. and the humidity was 5% rh, the amount of toner contained was 0.182 g. Thus, a change in environment causes a fluctuation in the replenishment agent discharging amount by as much as 5 to 6% at maximum.

When the replenishment operation is conducted by taking into account solely the toner density of the developer in the developing container 24, with the replenishment table unchanged, without taking into account the toner density of the replenishment agent, the amount of developer fluctuates, and the amount of toner contained therein fluctuates, which leads to a fluctuation in the density of the developer of the developing apparatus 3.

Thus, as in this embodiment, when an inductance detection sensor is used also in the hopper portion 41 as the toner density sensor 52, it is possible to ascertain the bulk density of the replenishment agent from the density detection result of the toner density sensor 52. That is, it is possible to ascertain the discharging amount when the replenishment screw 28*a* makes one rotation at the bulk density, so that it is possible to change the replenishment table accordingly, making it possible to accurately control the amount of replenishment agent to be supplied to the developing apparatus 3 and facilitate the stabilization of the T/D ratio of the developer in the developing apparatus 3.

Figure 9:
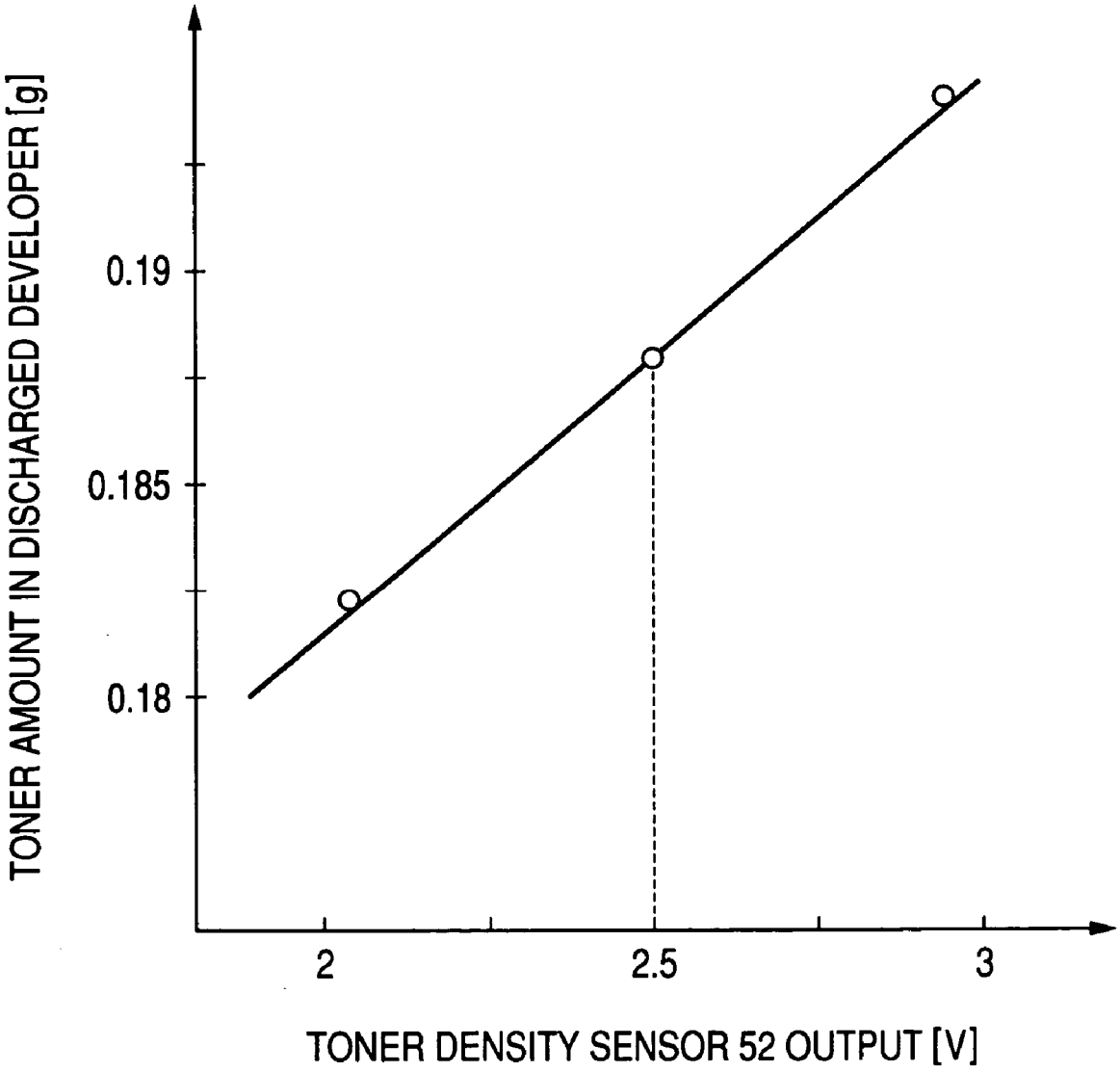
FIG. 9 is a graph showing the relationship between the output value of the first toner density detecting means according to the present invention and the toner amount in the developer discharged through one rotation of a replenishment screw.

To convert the output value of the toner density sensor 52, which is the inductance detection sensor, to the bulk density of the developer, it is necessary to grasp the relation between them beforehand. In the developer of this embodiment, when the bulk density is 0.536 g/cm$^3$, the output of the toner density sensor 52 is 2.5 V; when the bulk density is 0.519 g/cm$^3$, the output of the toner density sensor 52 is 2.1 V; and when the bulk density is 0.550 g/cm$^3$, the output of the toner density sensor 52 is 3.0 V. The discharging amount resulting from one rotation of the replenishment screw 28*a* when the output of the toner density sensor 52 is 2.5 V, 2.1 V, and 3.0, is 0.269 g, 0.260 g, and 0.276 g, respectively. At this time, the amount of toner in the developer is a value obtained by multiplying the discharging amount resulting from one rotation of the screw by the T/D ratio (which, in this case, is 70%, that is, 0.7). FIG. 9 is a diagram showing the relationship between the toner amount thus obtained and the output value of the toner density sensor 52, in which the vertical axis indicates toner amount and the horizontal axis indicates the output value of the toner density sensor 52. That is, by referring to FIG. 9, it is possible to find out the optimum toner replenishment amount taking into account the change in bulk density from the sensor output obtained. Thus, when performing replenishment control, the replenishment table, in which this relationship is taken into account, may be used.

As described above, the density of the replenishment agent is detected by the inductance detection sensor, and the replenishment table is selected taking into account the change in the bulk density of the replenishment agent, whereby it is possible to supply toner to the developing apparatus 3 in a satisfactory manner in any environment.

The dimensions, materials, configurations, relative positions, etc. of the components of the image forming apparatus described above should not be construed restrictively unless otherwise specified. That is, it is possible for the density of the replenishment agent and the method of supplying the same to be other than those described above.

As stated with reference to Embodiment 1, there are no particular limitations regarding the constructions of the image forming apparatus, the developing apparatus, and the replenishment agent supply device. However, the present invention is particularly effective when applied to the developing apparatus of an image forming apparatus, such as a color copying machine or a color printer, which often outputs image of high density.

This application claims priority from Japanese Patent Application No. 2004-105758 filed on Mar. 31, 2004, which is hereby incorporated by reference herein.

What is claimed is:

1. An image forming apparatus, comprising:

an image bearing member on which an electrostatic image is formed;

a developing apparatus having a developing container containing a developer including toner and carrier, a developer carrying member provided at the developer container for carrying and conveying the developer to develop the electrostatic image;

a supply device which performs a supply operation for supplying a replenishment developer including toner and carrier to the developing container; and a developer discharging port provided at the developing container for discharging the developer out of the developing container;

wherein the supply device comprises replenishment developer detecting means for detecting information regarding a ratio of the toner in the replenishment developer in the supply device, and wherein the supply device changes an operation condition in the supply operation in accordance with a detection result of the replenishment developer detecting means.

2. An image forming apparatus according to claim 1, further comprising developer detecting means for detecting information regarding a ratio of the toner in the developer in the developing container, wherein the supply device determines whether or not to perform the supply operation in accordance with a detection result of the developer detecting means.

3. An image forming apparatus according to claim 2, wherein each of the replenishment developer detecting means and the developer detecting means has an inductance detection sensor.

4. An image forming apparatus according to claim 1, further comprising a replenishment developer container, which contains the replenishment developer, wherein the supply device includes a communicating portion, which communicates the developer container and the replenishment developer container, and a conveying member, which is rotatably provided in the communicating portion and conveys the replenishment developer toward the developing container, and wherein the replenishment developer detecting means performs detection with respect to the replenishment developer in the communicating portion.

5. An image forming apparatus according to claim 4, further comprising developer detecting means for detecting information regarding a ratio of the toner in the developer in the developing container, wherein the supply device determines whether or not to drive the conveying member in accordance with a detection result of the developer detecting means, and wherein the supply device changes a rotation amount of the conveying member in accordance with the detection result of the replenishment developer detecting means.

6. An image forming apparatus according to claim 1, wherein the replenishment developer detecting means has an inductance detection sensor.

* * * * *

UNITED STATES PATENT AND TRADEMARK OFFICE

CERTIFICATE OF CORRECTION

PATENT NO. : 7,254,348 B2
APPLICATION NO. : 11/082921
DATED : August 7, 2007
INVENTOR(S) : Takashi Yahagi It is certified that error appears in the above-identified patent and that said Letters Patent is hereby corrected as shown below:

ON THE TITLE PAGE:

At Item (56), References Cited, FOREIGN PATENT DOCUMENTS, "62293267 A" should read --62-293267 A-- and "2000056639 A" should read --2000-56639 A--.

Signed and Sealed this

Sixth Day of May, 2008

JON W. DUDAS
*Director of the United States Patent and Trademark Office*